US006471163B1

(12) United States Patent
Brushwood

(10) Patent No.: US 6,471,163 B1
(45) Date of Patent: Oct. 29, 2002

(54) ERGONOMIC HAND THROW ARM FOR RAILROAD SWITCH MECHANISM

(75) Inventor: Daniel Brushwood, Saluda, SC (US)

(73) Assignee: Union Switch & Signal, Inc., Pittsburgh, PA (US)

( * ) Notice: Subject to any disclaimer, the term of this patent is extended or adjusted under 35 U.S.C. 154(b) by 0 days.

(21) Appl. No.: 09/973,658

(22) Filed: Oct. 9, 2001

(51) Int. Cl.[7] ..... B61L 5/00
(52) U.S. Cl. ..... 246/410
(58) Field of Search ..... 246/393, 403, 246/404, 406, 407, 408, 409, 410, 411, 412, 413

(56) References Cited

U.S. PATENT DOCUMENTS

| | | | | | |
|---|---|---|---|---|---|
| 121,419 | A | * | 11/1871 | Reynolds | 246/410 |
| 340,719 | A | * | 4/1886 | Jervis | 246/407 |
| 411,998 | A | * | 10/1889 | Newman | 246/412 |
| 585,065 | A | * | 6/1897 | Vanneste | 246/397 |
| 690,787 | A | | 1/1902 | Spangler | |
| 885,160 | A | | 4/1908 | Kidd | |
| 959,344 | A | * | 5/1910 | Homan | 246/397 |
| 1,267,998 | A | * | 5/1918 | Forth | 246/400 |
| 1,481,589 | A | * | 1/1924 | Cornell | 246/413 |
| 1,760,846 | A | * | 5/1930 | McGarry | 246/289 |
| 5,419,518 | A | | 5/1995 | Fiorenzo | |
| RE36,542 | E | | 2/2000 | Painter, Jr. et al. | |

* cited by examiner

*Primary Examiner*—Mark T. Le
(74) *Attorney, Agent, or Firm*—Brij K. Agarwal; Eckert Seamans Cherin & Mellott, LLC

(57) ABSTRACT

An improved ergonomic hand throw arm for use in conjunction with a railroad switch machine includes an elongated shank and a head disposed thereon. The shank includes a longitudinal axis, and the head includes a first opening and a second opening that are each offset in opposite directions from the longitudinal axis. The head includes an elongated rib that is disposed between the first and second openings and that extends in a direction that is substantially parallel with and may be in register with the longitudinal axis of the shank. The first and second openings are each elongated and are sized to permit the entry of a gloved hand therein yet resist the entry of a toe of a conventional steel toed boot or shoe that is manufactured according to Standard Z41 of the American National Standards Institute.

17 Claims, 2 Drawing Sheets

ERGONOMIC HAND THROW ARM FOR RAILROAD SWITCH MECHANISM

BACKGROUND OF THE INVENTION

1.Field of the Invention

The present invention relates generally to railroad switch mechanisms and, more particularly, to an ergonomic hand throw arm that is connectable with a switch machine.

2. Description of the Related Art

Numerous types of known railroad switch mechanisms are used for switching trains between a first set of railroad tracks and a second set of railroad tracks. Switch mechanisms typically are operatively connected with a pair of movable tracks that are selectively engagable with a first substantially stationary stock rail and with a substantially stationary stock rail.

Most, if not all, railroad switch mechanisms in use in the United States include a power apparatus, a locking apparatus, and a detection apparatus that extend between the switch machine and the movable tracks. The power apparatus provides the motile force to move the movable tracks from a first position engaged with the first stock rail to a second position engaged with the second stock rail. The locking apparatus retains the movable tracks in either the first position or the second position. The detection apparatus detects the position of the movable tracks with respect to the first and second stock rails to determine whether or not the movable tracks are correctly positioned.

Most switch machines include an electric motor as part of the power apparatus to provide the motile force that drives the movable tracks between the first and second positions. Most switch machines additionally have a hand throw arm that is connected with the power apparatus and that is manually pivotable between a first orientation and a second orientation to move the movable tracks between the first and second positions. The throw arm in the first orientation is typically oriented generally parallel with the railroad tracks and extends in a first direction away from the switch machine. The throw arm in the second orientation likewise typically is oriented generally parallel with the railroad tracks but extends away from the switch machine in a second direction opposite the first direction.

In manually moving the throw arm between the first and second orientations, a workman typically manually grasps the free end of the throw arm and pivots it upward and then downward through an arc of approximately 180°. Such manual shifting of the throw arm between the first and second orientations in order to move the movable tracks between the first and second positions typically is performed during a power outage or can be performed by a trainman who, when approaching the switch machine on a train, observes that the switch machine requires shifting between the first and second orientations. Manual shifting may also be performed in the event of a failure of a component of the power apparatus or in the absence of an electric motor. While such throw arms have typically been effective for their intended purposes, such throw arms have not, however, been without limitation.

In pivoting the throw arm between the first and second orientations, it has typically been necessary for a workman to bend over to lift the free end of the throw arm disposed adjacent the track, and must thereafter bend over a second time when repositioning the throw arm at its destination. Such bending, lifting, and pushing imparts great stresses to the lumbar region of the spine with the resultant potential for spinal injuries as a result of moving the throw arm between the first and second orientations. Additionally, the movable tracks are relatively heavy, and the mechanism that shifts the movable tracks between the first and second positions may be rusted, frozen, or dirty, such that the forces required to move the movable tracks between the first and second positions is significant. Moreover, the throw arm itself is relatively heavy and may include supplementary weights at the free end thereof in order to resist the throw arm from unintentionally moving between the first and second orientations during the passage of a train.

All of these factors increase to the level of force that must be applied by a workman while bending over, and likewise increase the potential for spinal injury to the workman. As a result, it has been known for workmen to use their feet to initially pivot the throw arm upward as well as to finally pivot the throw arm downward when pivoting the throw arm between the first and second orientations in order to avoid excessive lifting while bending over. Pivoting the throw arm with the foot has the potential, however, to damage the switch mechanism and to cause injury to the workman. It is thus desired to proved an improved hand throw arm for a railroad switch mechanism that reduces the potential for injury to a workman when pivoting the throw arm between the first and second orientations and that also resists the workman from pivoting the throw arm with a foot.

SUMMARY OF THE INVENTION

In view of the foregoing, an improved ergonomic hand throw arm for use in conjunction with a railroad switch machine includes an elongated shank and a head connected with one another. The shank includes a longitudinal axis, and the head includes a first opening and a second opening that are each offset in opposite directions from the longitudinal axis. The head includes an elongated rib that is disposed between the first and second openings and that extends in a direction that is substantially parallel with and may be in register with the longitudinal axis of the shank. The first and second openings are each elongated and are sized to permit the entry of a gloved hand therein yet resist the entry of a toe of a conventional steel toed boot or shoe that is manufactured according to Standard Z41 of the American National Standards Institute.

An aspect of the present invention is to provide an ergonomic hand throw arm that results in reduced spinal and other stresses to a workman who manually moves the throw arm between a first orientation and a second orientation.

Another aspect of the present invention is to provide an ergonomic hand throw arm having a first opening and a second opening that are offset in opposite directions from a longitudinal axis of the throw arm.

Another aspect of the present invention is to provide an ergonomic hand throw arm having a first opening and second opening that are favorably positioned relatively closer to a workman who is to manually pivot the throw arm between a first orientation and second orientation, yet is configured to resist the workman from misusing a switch machine to which the throw arm is operatively connected by resisting the entry into the openings of a toe of a steel toed boot or shoe.

Another aspect of the present invention is to provide an ergonomic hand throw arm having an elongated shank and a head, with the head including an elongated rib that is interposed between a first opening and a second opening formed in the head.

Accordingly, an aspect of the present invention is to provide a throw arm for a railroad switch machine, in which the general nature of the throw arm can be generally stated as including an elongated shank having a longitudinal axis, and a head connected with the shank, the shank being structured to be operatively connected with the railroad switch machine, the head being formed with a first opening and a second opening spaced from one another, and the first and second openings each being generally offset in opposite directions from the longitudinal axis of the shank.

Another aspect of the present invention is to provide a railroad switch mechanism, the general nature of which can be stated as including a switch machine and a throw arm operatively connected with the switch machine, the throw arm including an elongated shank and a head having a longitudinal axis, the head being disposed on an end of the shank opposite the switch machine, the head being formed with a first opening and a second opening spaced from one another, and the first and second openings each being generally offset in opposite directions from the longitudinal axis of the shank.

BRIEF DESCRIPTION OF THE DRAWINGS

A further understanding of the invention can be gained from the following description of the preferred embodiment when read in conjunction with the accompanying drawings in which.

Similar numerals refer to similar parts throughout the specification.

DESCRIPTION OF THE PREFERRED EMBODIMENTS

Figure 1:
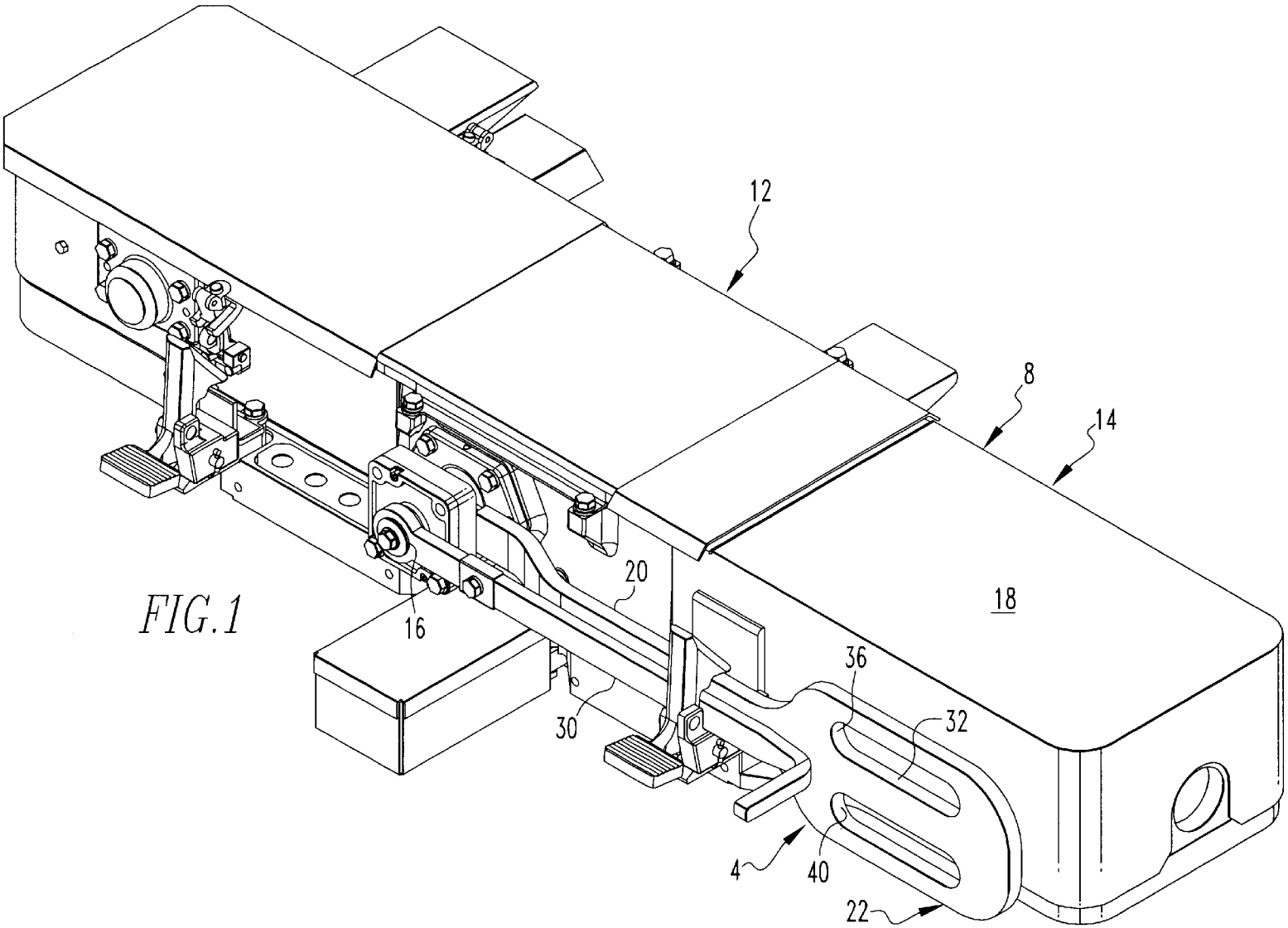
FIG. 1 is a perspective view of a railroad switch mechanism in accordance with the present invention incorporating an ergonomic hand throw arm in accordance with the present invention.
Figure 2:
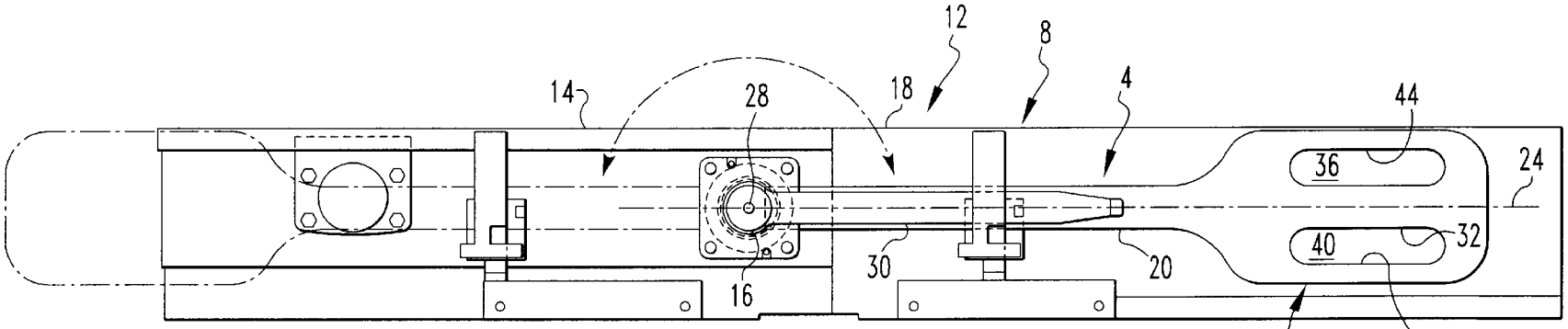
FIG. 2 is a front elevational view of the switch mechanism with the throw arm in a first orientation.
Figure 3:
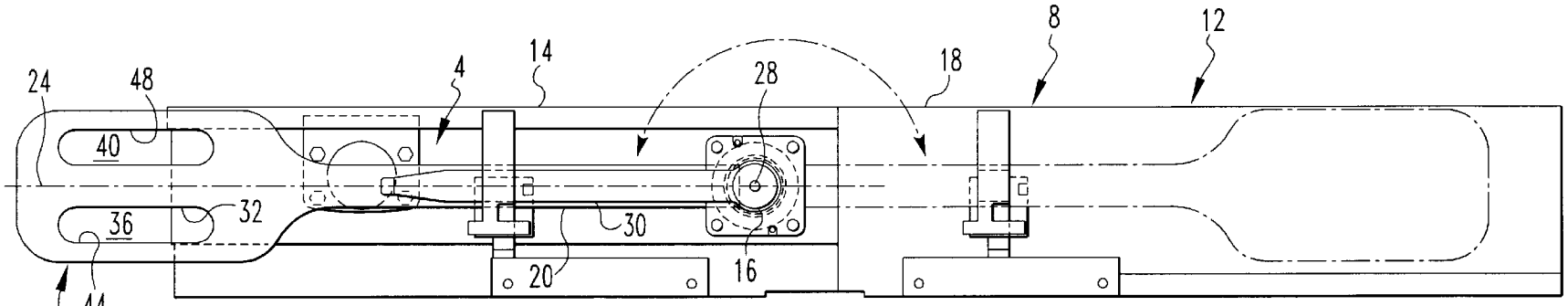
FIG. 3 is a view similar to FIG. 2, except depicting the throw arm in a second orientation.

An ergonomic hand throw arm 4 in accordance with the present invention is indicated generally in FIGS. 1–3. The throw arm 4 is depicted as being mounted on a railroad switch machine 8 to provide a railroad switch mechanism 12. As is understood in the relevant art, the railroad switch mechanism 12 is operatively connected with movable sections of railroad track (not shown) in order to permit a train (not shown) to be switched from a first set of railroad tracks to a second set of railroad tracks.

The switch machine 8 includes a housing 14 which houses machinery within that converts pivotal movement of the throw arm 4 into translational movement that can translate the movable tracks. Such machinery includes a pivot member 16 to which the throw arm 4 is connected. The housing 14 includes an upper wall 18, below which is disposed the machinery of the switch machine 8.

The throw arm 4 includes an elongated shank 20 and a head 22 connected with one another. The shank 20 includes a longitudinal axis 24 extending along its length and extending through a pivot point 28 of the pivot member 16 about which the pivot member 16 and the throw arm 4 arm are pivotable between a first orientation (FIG. 2) and a second orientation (FIG. 3). It is understood that the first orientation of the throw arm 4 corresponds with a first position of the movable tracks, and that the second orientation of the throw arm 4 corresponds with the second position of the movable tracks.

From FIGS. 2 and 3, it can clearly be seen that the head 22 is wider than the shank 20 in a direction perpendicular to longitudinal axis 24 for purposes to be set forth below. In this regard, it can also be seen that the head 22 flares outwardly from the shank 20 in a direction substantially perpendicular to the longitudinal axis 24.

The head 22 is mounted on the end of the shank 20 opposite the pivot member 16. In the embodiment of the switch mechanism 12 depicted in FIGS. 1–3, a selector bar 30 additionally extends from the pivot member 16 and is oriented in a direction generally parallel with the shank 20. The selector bar 30 is selectively pivotable between a first orientation (FIGS. 1 & 2) and a second orientation (FIG. 3) independently of the throw arm 4 and selectively operatively connects the movable tracks with either the throw arm 4 or the electric drive mechanism of the switch machine 8.

More specifically, when the selector bar 30 is in the first orientation (FIGS. 1 & 2) the movable tracks are operatively connected with the electric drive mechanism of the switch machine 8 whereby a remote operator can electrically shift the movable tracks between the first and second positions. In such circumstance, the throw arm 4 remains in the first orientation despite whether the movable tracks are in the first position or the second position inasmuch as the throw arm 4 is operatively disengaged from the movable tracks. When the selector bar 30 is pivoted to the second orientation (FIG. 3) the electric drive mechanism of the switch machine 8 becomes thereby disengaged from the movable tracks, with the movable tracks rather being operatively connected with the throw arm 4. As such, in order to manually shift the movable tracks between the first and second positions, the selector bar 30 is first pivoted from the first orientation to the second orientation after which the throw arm 4 can be selectively moved between the first and second orientations to shift the movable tracks between the first and second positions. During such pivoting of the throw arm 4, the selector bar 30 remains in the second orientation.

In order to return the movable tracks to operative engagement with the electric drive mechanism of the switch machine 8, the throw arm 4 is positioned in the first orientation, and the selector bar 30 is subsequently pivoted from the second orientation to the first orientation. By pivoting the selector bar 30 from the second orientation to the first orientation, the movable tracks are disengaged from the throw arm 4 and are operatively engaged with the electric drive mechanism of the switch machine 8.

It can be seen that the head 22 of the throw arm 4 is formed with an elongated first opening 36 and an elongated second opening 40 that are substantially parallel with each other. It can additionally be seen that the head 22 includes a rib 32 that is interposed between and helps to define the first and second openings 36 and 40.

The first and second openings 36 and 40 are advantageously sized to permit a gloved human hand to be received therein for purposes of pivoting the throw arm 4 between the first and second orientations, yet are sized to be small enough to resist a workman from inserting a toe from a steel toed boot or shoe that is constructed in accordance with Standard Z41 of the American National Standards Institute (ANSI), which is incorporated herein by reference, or an equivalent or more rigorous standard. As is understood in the relevant art, ANSI Standard Z41 sets forth specific guidelines as to the level of protection a steel toed boot or shoe must provide to the wearer, and as such a boot or shoe manufactured in accordance with the aforementioned standard will necessarily be of a certain size to provide such protection.

In this regard, the first and second openings 36 and 40 are preferably of a width in the range of about 1¼ to 2¼ inches and of a length in the range of about 7 to 8½ inches. It is understood, however, that the first and second openings 36 and 40 can be of dimensions greater and/or lesser than those set forth above so long as they are sized to permit the entry therein of gloved human hand yet resist the entry of a steel toed boot or shoe manufactured in accordance with ANSI Standard Z41.

It can be seen that the first and second openings 36 and 40 could be formed as a single large opening with the rib 32 being disposed in some fashion across the opening to resist the entry of a known steel toed boot or shoe. As such, while it is anticipated that the throw arm 4 will be formed out of a single piece of material such as steel or other appropriate material by appropriate methods such as stamping, cutting, forging, punching, and the like, the hand throw arm 4 may be configured out of multiple parts that are connected with one another by known methods.

In the embodiment of the throw arm 4 depicted in the accompanying figures, it can be seen that the first and second openings 36 and 40 are each offset in generally opposite directions from the longitudinal axis 24 in directions substantially perpendicular to the longitudinal axis 24. It can further be seen that the first and second openings 36 and 40 each extend in directions generally parallel with and spaced from the longitudinal axis 24 and substantially parallel with the rib 32.

Still further, it can be seen that the rib 32 extends in a direction generally parallel with the longitudinal axis 24 and is substantially in register with the longitudinal axis 24. In this regard, the expression"in register with" refers generally to the longitudinal axis 24 extending generally centrally along the rib 32. It is understood, however, that in other embodiments the rib 32 may be of other configurations and may not be in register with the longitudinal axis 24.

By offsetting the first and second openings 36 and 40 from the longitudinal axis 24, it can seen that when the throw arm 4 is in the first orientation the first opening 36 is disposed vertically higher than both the second opening 40 and the longitudinal axis 24. Similarly, when the throw arm 4 is in the second orientation, the second opening 40 is disposed vertically higher than both the first opening 36 and the longitudinal axis 24.

With regard to the first orientation of the throw arm 4, the vertically highest surface of the throw arm 4 adjacent the first opening 36 provides a first lifting surface 44 that can be grasped by a gloved hand of a workman when pivoting the throw arm 4 vertically upward from the first orientation. Similarly, when the throw arm 4 is in the second orientation, the vertically highest surface of the throw arm 4 adjacent the second opening 40 provides a second lifting surface 48 that can be grasped by the gloved hand of the workman when pivoting the throw arm 4 upward from the second orientation in a direction toward the first orientation. In this regard, it can be seen that the first and second lifting surfaces 44 and 48 are advantageously spaced a meaningful vertical distance from the longitudinal axis 24 in such a fashion that a workman bending over to grasp and pivot the throw arm 4 upward needs only to reach as far down as the vertically higher of the first and the second lifting surfaces 44 and 48. The first and second lifting surfaces 44 and 48 are spaced a relatively lesser distance vertically below the upper wall 18 of the housing 14 than previously known grip surfaces that were more closely aligned with a longitudinal axis of previously known throw arms. As such, the workman does not need to bend over as far to perform the pivoting operation on the throw arm 4 as was needed with previously known throw arms. By reducing the extent to which a workman must bend over and stress the spine during the pivoting operation, the risk of spinal injury to the workman has been correspondingly reduced by the throw arm 4 of the present invention.

Additionally, by providing the rib 32 that is disposed between the first and second lifting surfaces 44 and 48, the first and second openings 36 and 40 are defined on the head 22 and are sized to permit the entry of a gloved hand of a workman therein yet resist the entry of a steel toed boot or shoe of the workman manufactured in accordance with the aforementioned ANSI Standard Z41. With previously known throw arms having openings therein that were sized to accommodate a steel toed boot or shoe, it was known that a workman typically only partially pivoted the throw arm by hand and would perform the initial upward and/or the final downward pivoting operation by pressing upward and/or downward on a gripping surface defined on or within an opening of the throw arm with the workman's boot or shoe. Such a practice was dangerous for the workman inasmuch as the workman had a tendency to slip and fall with only one foot disposed on the ground, and additionally the foot that was pivoting the throw arm 4 was subject to twisting or injury by coming into contact with the upper wall 18 of the switch machine 8 when the throw arm was being pivoted downward past the housing 14. Workmen were known to use their boots or shoes in such a fashion in order to minimize the extent to which bending was required and to increase the force that could be applied to the throw arm. By configuring the throw arm 4 to have the head 22 with first and second openings 36 and 40 that are offset from the longitudinal axis 24, and by providing the rib 36 interposed between the first and second openings 36 and 40, a workman is substantially prevented from inserting his steel toed boot or shoe into the first and second openings 36 and 40, with the first and second openings 36 and 40 being positioned to reduce the extent to which bending is required. As such, the configuration of the head 22 advantageously reduces the risk of spinal injuries and other injuries to workmen that are related to bending and possible slipping and falling.

While a particular embodiment of the present invention has been described herein, it is understood that various changes, additions, modifications, and adaptations may be made without departing from the scope of the present invention, as set forth in the following claims.

What is claimed is:

1. A throw arm for a railroad switch machine, the throw arm comprising:

an elongated shank having a longitudinal axis; and a head connected with the shank;

the shank being structured to be operatively connected with the railroad switch machine; and the head being formed with a first opening and a second opening spaced from one another, the first and second openings each being generally offset in opposite directions from the longitudinal axis of the shank.

2. The throw arm as set forth in claim 1, in which the first and second openings are each offset substantially the same distance from the longitudinal axis.

3. The throw arm as set forth in claim 1, in which the first and second openings are each elongated in shape and extend in a direction generally parallel with the longitudinal axis.

4. The throw arm as set forth in claim 1, in which the first and second openings are each of a width in the range of about 1¼ to 2¼ inches and a length in the range of about 7 to 8½ inches.

5. The throw arm as set forth in claim 1, in which the head includes an elongated rib extending between the first and second openings.

6. The throw arm as set forth in claim 5, in which the rib extends in a direction generally parallel with the longitudinal axis.

7. The throw arm as set forth in claim 6, in which the rib is substantially in register with the longitudinal axis.

8. The throw arm as set forth in claim 1, in which tie first and second openings are each sized to pot the entry therein of a gloved adult human hand of a user yet resist the entry of a boot that is worn by the user.

9. A railroad switch mechanism comprising:

a switch machine; and a throw arm operatively connected with the switch machine;

the throw arm including an elongated shank and a head having a longitudinal axis;

the head being disposed on an end of the shank opposite the switch machine;

the head being formed with a first opening and a second opening spaced from one another, the first and second openings each being generally offset in opposite directions from the longitudinal axis of the shank.

10. The railroad switch mechanism as set forth in claim 9, in which the first and second openings are each offset substantially the same distance from the longitudinal axis.

11. The railroad switch mechanism as set forth in claim 9, in which the first and second openings are each elongated in shape and extend in a direction generally parallel with the longitudinal axis.

12. The railroad switch mechanism as set forth in claim 9, in which the first and second openings each have a width in the range of about 1¼ to 2½ inches and a length in the range of about 7 to 8½ inches.

13. The railroad switch mechanism as set forth in claim 9, in which the head includes an elongated rib extending between the first and second openings.

14. The railroad switch mechanism as set forth in claim 13, in which the rib extends in a direction generally parallel with the longitudinal axis.

15. The railroad switch mechanism as set forth in claim 14, in which the rib is substantially in register with the longitudinal axis.

16. The railroad switch mechanism as set forth in claim 9, in which the first and second openings an: each sized to it the entry therein of a gloved adult human hand of a user yet resist the entry of a boot that is worn by the user.

17. A railroad switch mechanism comprising:

a switch machine; and a throw arm operatively connected with the switch machine;

the throw arm including an elongated shank and a head having a longitudinal axis;

the head being disposed on an end of the shank opposite the switch machine;

the head being formed with a first opening and a second opening spaced from one another, the first and second openings each being generally offset in opposite directions from the longitudinal axis of the shank;

in which the throw arm is pivotable between a first orientation and a second orientation, the first opening being disposed vertically above the second opening when the throw arm is in the first orientation, the second opening being disposed vertically above the first opening when the throw arm is in the second orientation.

* * * * *

UNITED STATES PATENT AND TRADEMARK OFFICE

CERTIFICATE OF CORRECTION

PATENT NO. : 6,471,163 B1
DATED : October 29, 2002
INVENTOR(S) : Daniel Brushwood It is certified that error appears in the above-identified patent and that said Letters Patent is hereby corrected as shown below:

Column 7,
Line 9, “tie” should read -- the --.
Line 10, “pot” should read -- permit --.

Column 8,
Line 11, “an:” should read -- are --.
Line 11, “it” should read -- permit --.

Signed and Sealed this

Eleventh Day of March, 2003

JAMES E. ROGAN
*Director of the United States Patent and Trademark Office*